US010066824B2

(12) United States Patent
Wu et al.

(10) Patent No.: US 10,066,824 B2
(45) Date of Patent: Sep. 4, 2018

(54) LED FILAMENT LAMP

(71) Applicant: Xiamen Eco Lighting Co. Ltd, Xiamen (CN)

(72) Inventors: Feng Wu, Xiamen (CN); Yunwei Chen, Xiamen (CN); Minghao Wu, Xiamen (CN); Fuwen Li, Xiamen (CN)

(73) Assignee: Xiamen Eco Lighting Co. Ltd, Xiamen (CN)

( * ) Notice: Subject to any disclaimer, the term of this patent is extended or adjusted under 35 U.S.C. 154(b) by 0 days.

(21) Appl. No.: 15/185,036

(22) Filed: Jun. 17, 2016

(65) Prior Publication Data

US 2016/0369949 A1 Dec. 22, 2016

(30) Foreign Application Priority Data

Jun. 19, 2015 (CN) ..... 2015 1 0342819

(51) Int. Cl.

| | |
|---|---|
| ***F21V 29/00*** | (2015.01) |
| ***F21V 29/70*** | (2015.01) |
| ***H05B 35/00*** | (2006.01) |
| ***F21K 9/232*** | (2016.01) |
| ***F21K 9/238*** | (2016.01) |
| ***F21K 9/235*** | (2016.01) |
| ***F21K 99/00*** | (2016.01) |
| ***F21V 3/02*** | (2006.01) |
| ***F21V 17/10*** | (2006.01) |
| ***F21V 19/00*** | (2006.01) |
| ***F21V 23/00*** | (2015.01) |

(Continued)

(52) U.S. Cl.

CPC ..... *F21V 29/70* (2015.01); *F21K 9/1355* (2013.01); *F21K 9/232* (2016.08); *F21K 9/235* (2016.08); *F21K 9/238* (2016.08); *F21V 3/02* (2013.01); *F21V 3/0615* (2018.02); *F21V 17/101* (2013.01); *F21V 19/006* (2013.01); *F21V 23/003* (2013.01); *F21V 23/06* (2013.01); *F21V 31/005* (2013.01); *H05B 35/00* (2013.01); *F21Y 2101/00* (2013.01); *F21Y 2107/00* (2016.08); *F21Y 2115/10* (2016.08)

(58) Field of Classification Search

CPC ..... F21K 9/235; F21K 9/232; F21K 9/237; F21K 9/238; F21V 3/0427; F21V 17/101

See application file for complete search history.

(56) References Cited

U.S. PATENT DOCUMENTS 4,302,799 A * 11/1981 Behrens ..... F21V 15/00 362/145

2012/0162965 A1* 6/2012 Takeuchi ..... F21K 9/235 362/84

(Continued)

*Primary Examiner* — Evan Dzierzynski

(74) *Attorney, Agent, or Firm* — Gokalp Bayramoglu

(57) ABSTRACT

An LED filament lamp comprises a bulb shell and an LED filament component located inside the bulb shell. The LED filament lamp further comprises a driving board, a lamp holder bulb shell and an inside liner. The inside liner is a bulb shell structure made of insulating material and installed inside the lamp holder bulb shell. At least a part of the driving board is located inside the inside liner to make the driving board and the lamp holder bulb shell separate from each other. The LED filament component is electrically connected to the driving board and the lamp holder bulb shell is electrically connected to the driving board. The LED filament lamp has characteristic of simple structure.

11 Claims, 3 Drawing Sheets

(51) Int. Cl.

| | |
|---|---|
| ***F21V 23/06*** | (2006.01) |
| ***F21V 31/00*** | (2006.01) |
| ***F21V 3/06*** | (2018.01) |
| *F21Y 107/00* | (2016.01) |
| *F21Y 115/10* | (2016.01) |
| *F21Y 101/00* | (2016.01) |

(56) References Cited

U.S. PATENT DOCUMENTS

2013/0070456 A1* 3/2013 Jang ..... F21V 3/00
362/235
2014/0375202 A1* 12/2014 Yang ..... F21V 29/004
313/36
2015/0043212 A1* 2/2015 Coffey ..... F21V 23/045
362/294
2016/0091179 A1* 3/2016 Jiang ..... F21V 19/009
362/218

* cited by examiner

LED FILAMENT LAMP

CROSS REFERENCE TO RELATED APPLICATIONS

This application is based upon and claims priority to Chinese Patent Application No. 201510342819.0, filed on Jun. 19, 2015, the entire contents of which are incorporated herein by reference.

FIELD OF THE INVENTION

The present invention relates to a lighting fixture, and more specifically relates to an LED filament lamp.

BACKGROUND OF THE INVENTION

LED filament lamp is an illumination device, which uses LED filament as its light source. The LED filament lamp generally comprises a transparent bulb shell and an LED filament. The LED filament is located inside the transparent bulb shell, and then fills the transparent bulb shell with gases, to achieve the illumination of the filament lamp. LED filament can also be called the LED illumination strip. The LED filament lamp can also be called the LED bulb or ball lamp. The LED filament lamp has the advantages of 360-degree illumination and high utilization rate of light. Thus, the LED filament becomes more and more popular and will become a trend in the future.

Chinese patent No. 201420674092.7 (granted in Nov. 12, 2014), titled LED filament lamp and light bulb, discloses a lamp holder structure and an electric board contained in the lamp holder structure. The lamp holder structure comprises a bulb shell and a light base installed on the inner surface of the bulb shell. The installation component is installed on the lamp base. The electric board has an installation hole that matches the installation component in their positioning. This structure can fix the electric board on the lamp holder, however, a welding process to electrically connect the electric board and the lamp holder is still needed, furthermore, a short circuit between the electric board and the lamp holder would still be problematic.

SUMMARY OF THE INVENTION

In order to overcome the drawbacks of said invention, the present invention discloses an LED filament lamp with a simple structure.

The LED filament lamp comprises a bulb shell and an LED filament component located inside the bulb shell. The LED filament lamp further comprises a driving board, lamp holder bulb shell and an inside liner. The inside liner is a bulb shell structure made of insulating material and installed inside the lamp holder bulb shell. At least a part of the driving board is located inside the inside liner to make the driving board and the lamp holder bulb shell separate from each other. The LED filament component is electrically connected to the driving board and the lamp holder bulb shell is electrically connected to the driving board.

Compared to the structure of prior art, the inside liner made of insulating material is located in the lamp holder bulb shell and at least a part of the driving board is further located inside the inside liner to separate the driving board and the bulb shell of the lamp holder. In this way, the short circuit problem between the driving board and the lamp holder can be avoided. Furthermore, the LED filament lamp of the present disclosure has a simple structure and can be easily assembled.

DETAILED DESCRIPTION OF THE INVENTION

Hereinafter, this disclosure is described in conjunction with the figures and specific embodiments.

Figure 1:
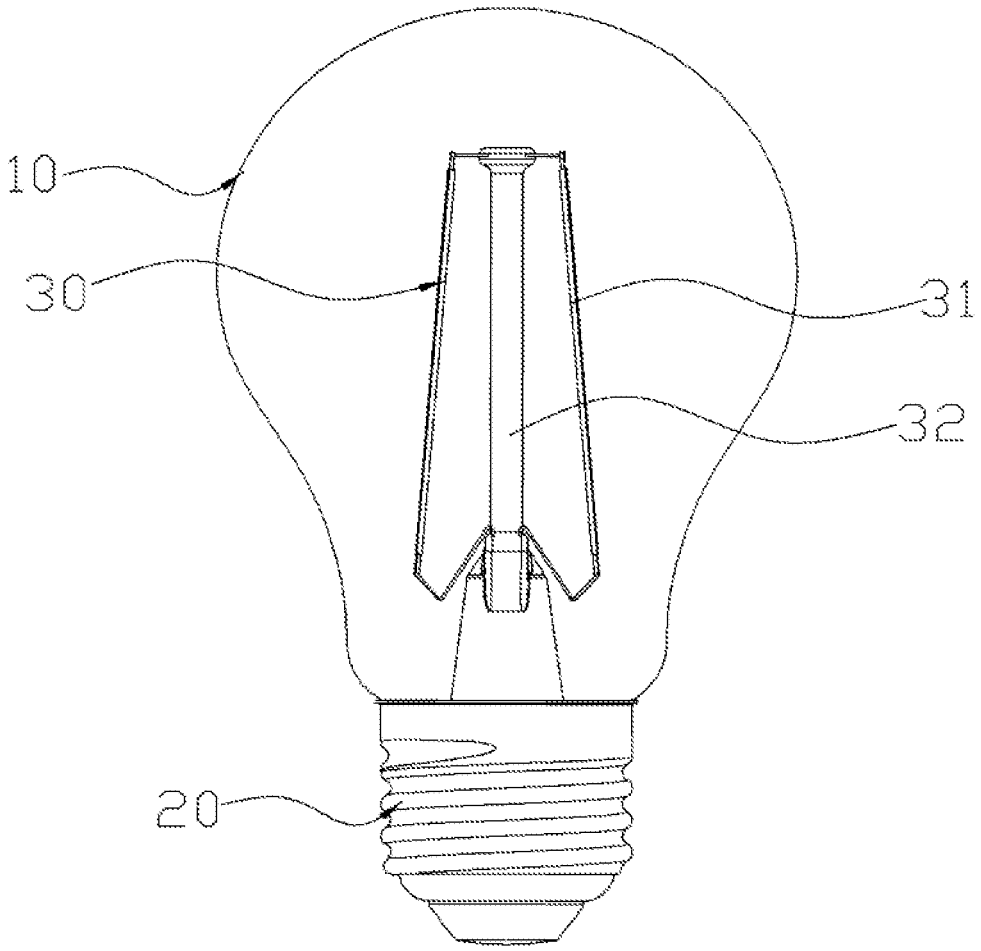
FIG. 1 shows the front view of an embodiment of the LED filament lamp.
Figure 2:
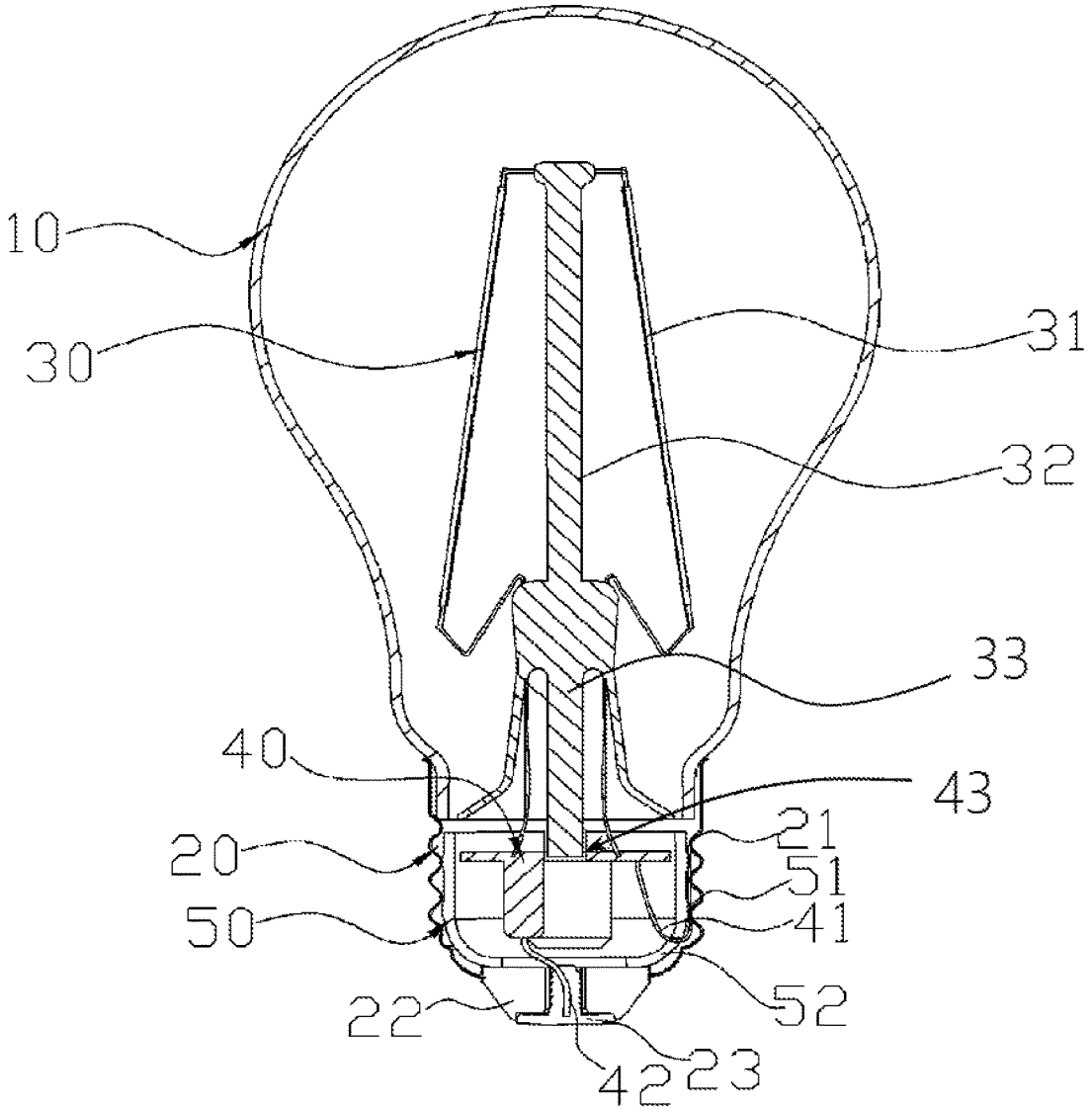
FIG. 2 shows the cross section view of FIG. 1.
Figure 3:
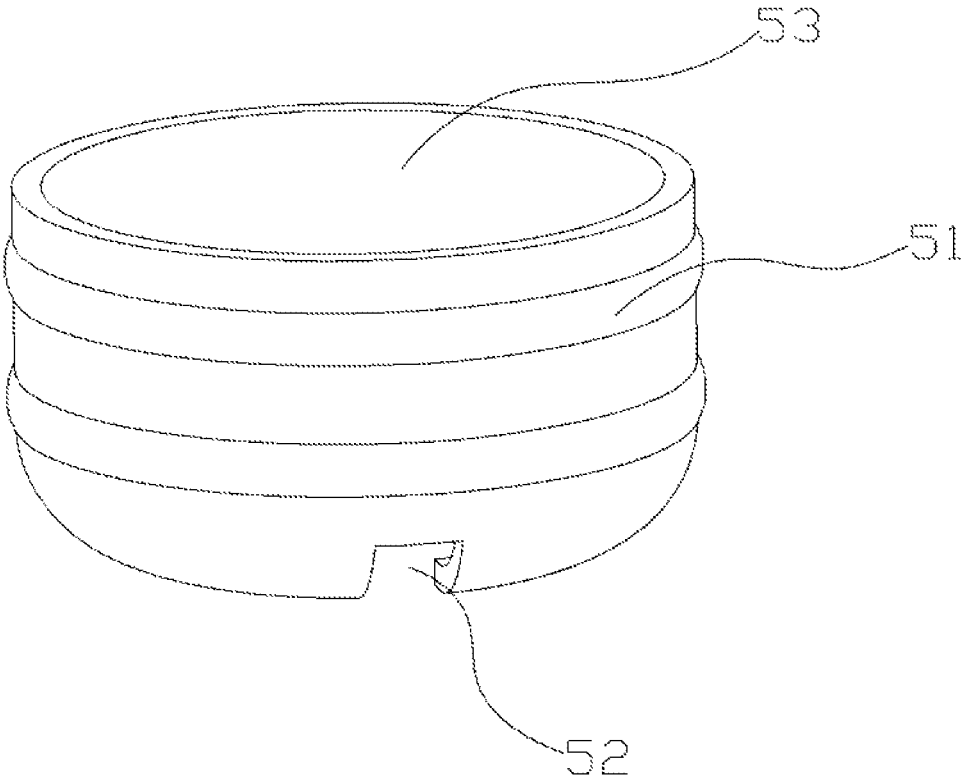
FIG. 3 shows the stereo view of the inside liner of FIG. 1.

Referring to FIGS. 1-3, LED filament lamp 100 of one embodiment is provided.

LED filament lamp 100 comprises globe bulb shell 10 and LED filament component 30 located in globe bulb shell 10. LED filament lamp 100 further comprises driving board 40, lamp holder bulb shell 20 and inside liner 50. Inside liner 50 is a bulb shell structure made of insulating material and located inside lamp holder bulb shell 20. At least a part of driving board 40 is located in inside liner 50 to separate driving board 40 and lamp holder bulb shell 20. LED filament component 30 are electrically connected to driving board 40 and driving board 40 is electrically connected to lamp holder bulb shell 20.

Referring to FIGS. 1-3, lamp holder bulb shell 20 includes first electric terminal 21, second electric terminal 23 and insulating part 22 installed thereon. In one embodiment, lamp holder bulb shell 20 is a standard E27 screw based structure. First electric terminal 21 is an annular sidewall with a screw groove. Second electric terminal 23 is an eye pad made of metal. Insulating part 22 is an annular structure. First electric terminal 21 includes openings on the top and bottom. Second electric terminal 23 connects to first electric terminal 21 through insulating part 22. Driving board 40 includes first electrode 41 and second electrode 42 located thereon. Inside liner 50 includes hole 53 therein. First electrode 41 and second electrode 42 of driving board 40 pass through hole 53 and respectively connect with first electric terminal 21 and second electric terminal 23 of lamp holder bulb shell 20.

Inside liner 50 is fixed inside first electrical terminal 21. First electrode 41 is a conductive wire and electrically connects to first electrical terminal 21. First electrode 41 is deviously located between inside liner 50 and the sidewall of lamp holder bulb shell 20. Second electrode 42 is a conductive wire and is fixed between second electric terminal 23 and insulating part 22 using pressure.

Referring to FIGS. 1-3, inside liner 50 is made of deformable material. Convex ring 51 is located in outside wall of inside liner 50. Inside liner 50 is fixed to the inside of first electric terminal 21 through convex ring 51. First electrode 41 is located between convex ring 51 and first electric terminal 21. Hooking slot 52 is located on the sidewall of inside liner 50 and connects to hole 53. First electrode 41 passes through hooking slot 52.

First electrical terminal 21 has a spiral groove. Two convex rings 51 are fixed on the outside wall of inside liner 50. Distance between two convex rings 51 corresponds to the distance between consecutive troughs of the spiral groove.

Referring to FIGS. 1-2, globe bulb shell 10 is a transparent or translucent glass bulb shell and is located on lamp holder bulb shell 20. Lamp holder bulb shell 20 is secured on globe bulb shell 10 through welding mud powder.

LED filament component 30 comprises core pillar 32 and LED filament 31. LED filament 31 comprises a transparent substrate and LED chip sealed in the transparent substrate. The connecting pillar 33 is located on core pillar 32 faced to driving board 40. The connecting part 43 is located on driving board 40 and is clamped to the bottom of the connecting pillar 33.

Globe bulb shell 10 and LED filament component 30 forms a sealed chamber. Gases with low molecular weight and high thermal conductivity are filled in the sealed chamber. The gases are capable of transmitting heat generated from LED filament component 30 to globe bulb shell 10. Gas used can be Helium, hydrogen, oxygen, carbon dioxide or any of the inert gases, such as Neon and argon. Other gases that can be used include Ethers, methane and ammonia.

Since inside liner 50 is made of insulating material and driving board 40 and lamp holder bulb shell 20 are separated from each other by inside liner 50, short circuits resulting from contact between driving board 40 and lamp holder bulb shell 20 can be avoided. Inside liner 50 can also stop the accidental contact between driving board 40 and lamp holder bulb shell 20 during transportation and large vibration. First electrode 41 can be fixed by hooking slot 52, thus movements of first electrode 41 along the outer peripheral of inside liner 50 and affection of the electrical connection therebetween can be reduced. As the globe bulb shell and the LED filament component forms a sealed chamber and high thermal conductivity gas is filled therein, LED filament lamp 100 has the advantage of good heat dissipation. Globe bulb shell 10 is stably secured to lamp holder bulb shell 20 through welding mud powder. Inside liner 50 and lamp holder bulb shell 20 is interference assembled, thus inside liner 50 can be steadily snapped into lamp holder bulb shell 20 without additional structure.

Because core pillar 32 is fixed onto driving board 40 through a connecting pillar 33, the relationship between driving board 40 and core pillar 32 is fixed. The electrical connection between filament components 30 and driving board 40 damaged by the motion of driving board 40 can be avoided. The setting of the connecting pillar 33 makes the overall structure steadier. As first electrode 41 is deviously located between inside liner 50 and the sidewall of lamp holder bulb shell 20, and second electrode 42 is pressured by convex ring 51 located on the outside wall of inside liner 50, first electrode 41 can be electrically connected to the sidewall of lamp holder bulb shell 20 without an additional conductor and can be easily assembled.

As stated above, by separating driving board 40 from lamp holder bulb shell 20 via setting inside liner 50, the short circuit issue caused by directly inserting driving board 40 into lamp holder bulb shell 20 can be reduced. First electrode 41 is deviously located between inside liner 50 and the sidewall of lamp holder bulb shell 20. First electrode 41 can be electrically connected to the sidewall of lamp holder bulb shell 20 with the setting of convex ring 51. By designing the electric connection between driving board 40 and LED filament component 30 and the electrical circuit between driving board 40 and lamp holder bulb shell 20, the overall electrical structure of the lamp is modified, simplified and easily assembled.

It is to be noted that, hooking slot 52 installed on the outside wall of inside liner 50 is optional. Hooking slot 52 is used to avoid any affects on the electrical connection by movement of first electrode 41 along the outer peripheral of inside liner 50. Other ways of fixing can be used, if inside liner 50 matches closely with the side wall of lamp holder 20 to fix first electrode 41, hooking slot 52 can be optional or be replaced by other fixtures, such as through a hole or hooker, when the electrical connection between first electrode 41 and lamp holder bulb shell 20 is not affected.

The above disclosures are the descriptions of preferred embodiments. This disclosure should cover all equivalent modifications and combinations of these embodiments, and is not limited to these embodiments.

What is claimed is:

1. An LED filament lamp, comprising:

a bulb shell;

an LED filament component located in the bulb shell;

a driving board, a lamp holder casing and an inside liner;

wherein the inside liner is a shell structure made of insulating material and installed inside the lamp holder casing;

at least a part of the driving board is located inside the inside liner to make the driving board and the lamp holder casing separated from each other;

the LED filament component is electrically connected to the driving board and the lamp holder casing is electrically connected to the driving board; and the LED filament component further includes a core pillar and a LED filament, wherein a sealed chamber is formed by the bulb shell and the LED filament component.

2. The LED filament lamp of claim 1, wherein the lamp holder casing comprises a first electric terminal, a second electric terminal and an insulting part installed thereon;

wherein the second electric terminal connects to the first electric terminal through the insulting part;

the driving board further includes a first electrode and a second electrode, and the first electrode and the second electrode are located on the driving board;

the inside liner includes a hole, and the hole is located inside the inside liner; and the first electrode and the second electrode of the driving board pass through the hole and respectively connect to the first electric terminal and the second electric terminal of the lamp holder casing.

3. The LED filament lamp of claim 2, wherein the first electric terminal is an annular sidewall;

the inside liner is fixed inside the first electrical terminal;

the first electrode is a conductive wire; and the first electrode is bent and located between the inside liner and the sidewall of the lamp holder casing, the first electrode is electrically connected with the first electrical terminal.

4. The LED filament lamp of claim 3, wherein the inside liner is made of deformable material, the inside liner is interference assembled with the lamp holder casing;

at least one convex ring is located in an outside wall of the inside liner;

the whole inside liner is fixed inside the first electric terminal through the convex ring; and the first electrode is clamped between the convex ring and the first electric terminal.

5. The LED filament lamp of claim 4, wherein the first electrical terminal includes at least one spiral groove;

wherein two convex rings are fixed on the outside wall of the inside liner; and wherein a distance between the two convex rings corresponds to a distance between consecutive troughs of the spiral groove.

6. The LED filament lamp of claim 3, wherein a hooking slot is installed on a wall of the inside liner;

wherein the hooking slot connects with the hole; and the first electrode passes through the hooking slot.

7. The LED filament lamp of claim 1, wherein the bulb shell is a transparent or translucent glass bulb shell and is located on the lamp holder casing; and wherein the lamp holder casing is secured on the bulb shell through welding mud powder.

8. The LED filament lamp of claim 7, gases with a predetermined molecular weight and a predetermined thermal conductivity are filled in the sealed chamber; and the gases transmit heat generated from the LED filament component to the bulb shell.

9. The LED filament lamp of claim 1, wherein the LED filament includes a transparent substrate and an LED chip is sealed in the transparent substrate.

10. The LED filament lamp of claim 1, wherein a connecting pillar is located on a core pillar facing to the driving board; and wherein a connecting part is located on the driving board and is clamped at a bottom of the connecting pillar.

11. The LED filament lamp of claim 1, wherein gases with a predetermined molecular weight and a predetermined thermal conductivity are filled in the sealed chamber; and the gases transmit heat generated from the LED filament component to the bulb shell.

* * * * *